United States Patent [19]

Reynolds

[11] 4,143,477

[45] Mar. 13, 1979

[54] VARIABLE INDEX TAB FOR A FILE FOLDER

[76] Inventor: Henri M. Reynolds, 106 Hillcrest Dr., Macungie, Pa. 18062

[21] Appl. No.: 805,073

[22] Filed: Jun. 9, 1977

[51] Int. Cl.[2] ..... B42F 21/00

[52] U.S. Cl. ..... 40/359; 40/5; 40/524

[58] Field of Search ..... 40/23 A, 5, 359, 360, 40/524

[56] References Cited

U.S. PATENT DOCUMENTS

| | | | |
|---|---|---|---|
| 1,751,495 | 3/1930 | Robinson | 40/5 UX |
| 2,016,259 | 10/1935 | Schnitz | 40/360 X |
| 2,597,426 | 5/1952 | Auckley | 40/359 X |
| 3,321,854 | 5/1967 | Faul | 40/5 |

*Primary Examiner*—Louis G. Mancene
*Assistant Examiner*—Wenceslao J. Contreras
*Attorney, Agent, or Firm*—Fred Fisher

[57] ABSTRACT

An index tab for a file folder includes an integral base member adapted to be affixed to the file folder. The base member includes a relatively flat base portion engageable with a surface of the file folder, the base portion having a pair of opposed strip engageable notches at opposite edges of the member. The base portion further includes at least one ear means bent about the base portion and engageable with an opposite surface of the file folder. A rotatable strip of flexible material circumscribes the base portion and engages within the opposed strip engageable notches. The strip carries a series of indentifying indicia. The ear means, in one version, can be bent about a fixed axis and a point on the strip is rotatable within a plane which is perpendicular to the fixed axis. In another version, a point on the strip is rotatable within a plane which is parallel to the fixed axis.

The rotatable strip can include alphanumeric indicia such as numerals, months, years, dates, and color. Alternatively, several rotatable means can be used to indicate multiple indicia, such as days, years, etc.

16 Claims, 16 Drawing Figures

VARIABLE INDEX TAB FOR A FILE FOLDER

BACKGROUND OF THE INVENTION

1. Field of the Invention

This invention relates to a variable index tab for a file folder. The term "file folder", as used herein, is not meant to be limiting in any manner whatsoever, but includes a ledger sheet, a card, and any flexible sheet or folder which is filed vertically in cabinets, drawers, and the like or in books. Accordingly, it is a general object of this invention to provide a variable index tab which can be installed onto a file folder or equivalent as defined hereinabove, and which is visible at the top or sides thereof and which can be adjusted to bring different distinguishing marks, colors, or other indicia into view at the top or side of the file folder.

2. Description of the Prior Art

In accordance with a preliminary novelty search performed on behalf of the inventor, the following United States patents were deemed to be of interest:

| U.S. Pat. No. | Patentee | Issue Date |
|---|---|---|
| 1,751,495 | G. S. ROBINSON | March 25, 1930 |
| 2,249,879 | W. J. BESSLER | July 22, 1941 |

The field of search included the following subclasses:
40–5, 23A, 23, 359, 360
283–39. 41

Robinson, U.S. Pat. No. 1,751,495, discloses an adjustable tab on a card, typical to similar patents which disclose a rotatable disc type. Robinson discloses a system which requires that the disk be supported within formed slots on the card or ledger sheet. Disadvantageously, old record sheets require punching (as disclosed at page 2, lines 41–46 of Robinson) and such sheets, if light paper is used, may require reinforcement (page 2, lines 47–49).

Bessler, U.S. Pat. No. 2,249,879, relates to a device which is designed to be a clip-on structure for clipping on a shelf in a store to show the price of articles. It is not designed for use with a card or folder. It is constructed with one or several continuous bands with a series of numbers thereon and the numbers can be changed for showing price by movement of the band. The Bessler device utilizes an exhibitor which includes a channelled leg, backing plate, risers, and a top leg in vertically spaced relation. It further requires a web, a pair of rolls, and a mover which includes a downturned finger engageable portion. Disadvantageously, at least so far as modification of Bessler might be contemplated for use in art other than clipping on a shelf, Bessler utilizes multiple parts which are relatively bulky, in a three dimensional context, and is not adaptable for file folders, does not lie flat, and is comparatively expensive.

SUMMARY OF THE INVENTION

It is another object of this invention to provide a new and improved variable index tab for a file folder which does not require modification of the file folder in any manner whatsoever.

Still another object of this invention is to provide a new and improved variable index tab for a file folder which utilizes a minimum number of components.

Yet another object of this invention is to provide a new and improved variable index tab for a file folder which both does not require modification of the file folder and which furthermore is reasonably inexpensive to produce.

In accordance with one embodiment of the invention, the variable index tab for the file folder includes an integral base member having a relatively flat base portion adapted to be engaged with one surface of the file folder. The relatively flat base portion has a pair of opposed strip engageable notches at opposite edges of the member. The base portion further includes at least one ear means which is bendable about the base portion and which is adapted to be engaged with an opposite surface of the file folder. The index tab further includes a rotatable strip of flexible material circumscribing the base portion and engageable within the opposed strip engageable notches. The strip carries a series of identifying indicia. In accordance with one feature of the invention, the ear means can be bent about a fixed axis and a point on the strip is rotatable within a plane which is perpendicular to the fixed axis.

In accordance with another feature of the invention, the ear means can be bent about a fixed axis and a point on the strip is rotatable within a plane which is parallel to the fixed axis.

In accordance with another embodiment of the invention, a variable index tab for a file folder includes a relatively flat base member including a bendable portion adapted to be affixed about an edge of the file folder. The base member is formed with a notch at two opposite sides of the member. The index tab further includes a rotatable strip of flexible material circumscribing the member and engaged within the notches. This strip carries a series of indentifying indicia. In accordance with one feature of the invention, the tab further comprises an adhesive backing formed on a portion of the base member. In accordance with another feature of the invention, the bendable portion is bendable about a line and a point on the strip is adapted to rotate about a path wherein the path forms a plane parallel to the line. In accordance with yet another feature of the invention, the bendable portion is bendable about a line and a point on the strip is adapted to rotate about a path forming a plane perpendicular to the line. With still another feature, the member can be metallic, and the member portion is formed with teeth for mechanically engaging with the folder. In accordance with yet another feature of the invention, the base member is provided with a like plurality of spaced notches at two opposite sides of the member. The index tab, in addition to the member, includes a like plurality of rotatable strips of flexible material circumscribing the member and respectively engaged within an opposing pair of the notches. Each of the strips carries a series of identifying indicia. In accordance with a sub-feature, the referred to like plurality is two.

In accordance with still another embodiment of the invention, a novel combination includes a file folder having a reference edge and a side edge which intersects with the reference edge, and containing a slit which is parallel to one of the edges. The combination further includes a rotatable strip of flexible material which circumscribes a portion of the file folder and is bounded by the aforesaid one edge and the slit. In accordance with one feature of the invention, the foregoing one edge is the reference edge. Alternatively, however, the foregoing one edge can be the side edge. In accordance with specific features of the invention, where the foregoing one edge is the reference edge, the slit extends to the side edge. In accordance with one sub-feature of the invention, the portion of the slit which is not bounded by the strip is closed by tape means which extends to the side edge. In accordance with another sub-feature of the invention, the slit does not extend to the side edge.

BRIEF DESCRIPTION OF THE DRAWINGS

Other objects, advantages, and features of this invention will become more apparent from the following description, when read in conjunction with the accompanying drawing, in which:

FIGS. 15 and 16 are views of still another embodiment of the invention, wherein FIG. 15 shows a face portion of a file folder deleted, and FIG. 16 shows it in place.

DESCRIPTION OF ONE EMBODIMENT OF THE INVENTION

Figure 1:
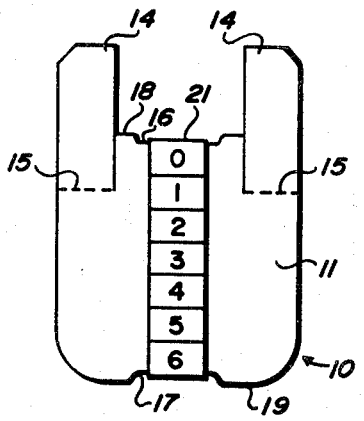
FIG. 1 is a front view of one embodiment of the invention.
Figure 2:
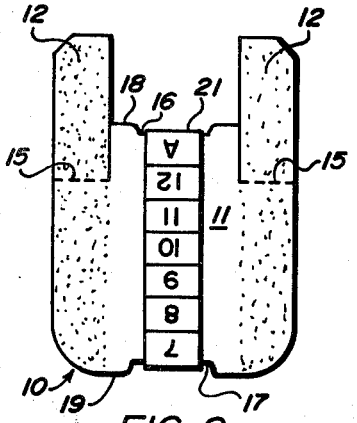
FIG. 2 is a rear view thereof.
Figure 4:
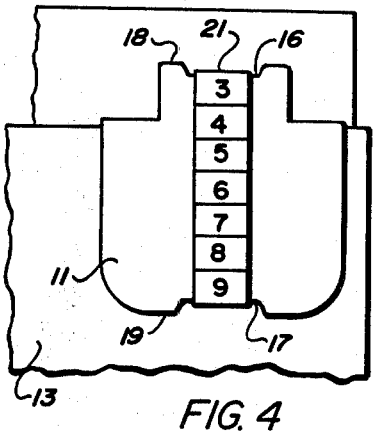
FIG. 4 is a view of the embodiment shown in FIGS. 1-3 as applied to a portion of a file folder.

Referring to FIGS. 1 and 2, there is shown a front and rear view, respectively, of a variable index tab for a file folder prior to its use. The variable index tab includes an integral base member 10. The member 10 includes a relatively flat base portion 11 having an adhesive backing surface 12—12 formed on the left and right sides of the rear, as shown in FIG. 2. The adhesive backing surface 12 is adapted to engage with the surface of a file folder 13 (FIG. 4).

The variable index tab includes a pair of ears 14—14 which are bendable about a dotted line 15—15 as depicted in FIGS. 1 and 2. The ears 14—14, when bent, form the position generally shown in FIG. 3 (the file folder 13 is omitted from FIG. 3 for clarity of explanation.).

Figure 3:
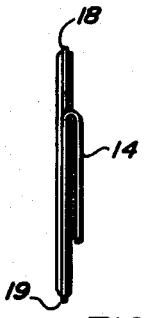
FIG. 3 is a side view of the embodiment shown in FIGS. 1 and 2 with the extendible ear means shown in bent form.

The index tab of FIGS. 1, 2, and 3 has the relatively flat base portion 11 formed with a pair of opposed strip engageable notches 16-17 at opposite edges 18-19 of the integral base member 10.

The variable index tab includes a rotatable strip 21 of flexible material which circumscribes the base portion 11 and engages within the opposed strip engageable notches 16-17. The strip carries a series of identifying indicia, such as alphanumeric designations, color coding, days of the week, months, and the like.

In the preferred embodiment depicted in FIGS. 1-4, the variable index tab includes an integral base member which is formed of heavy paper. The index tab, alternately, can be constructed of cardboard or suitable plastic material. The rotatable strip is formed of polyethelene terephthalate, such as that sold under the trademark Mylar. The use of polyethelene terephthalate is preferred due to its long wearing characteristics.

The adhesive material 12, preferably, is self sticking so that it can adhere to the file folder.

In use, the variable index tab is affixed to the file folder 13, as shown in FIG. 4. The rotatable strip of rotatable material 21 can be rotated freely about the base portion 11, so that any desired indicia on the flexible strip is presented uppermost on the file folder. The strip of material 21 is freely rotatable, manually; however, upon removal of finger pressure to rotate same, the strip 21 stays in place due to static friction which exists between the strip 21 and the base portion 11, and the strip 21 and the file folder 13. The strip 21, as is apparent from the drawing, is rotatable so that a point on the strip rotates within a plane which is perpendicular to the line 15—15.

DESCRIPTION OF ANOTHER EMBODIMENT OF THE INVENTION

Figure 5:
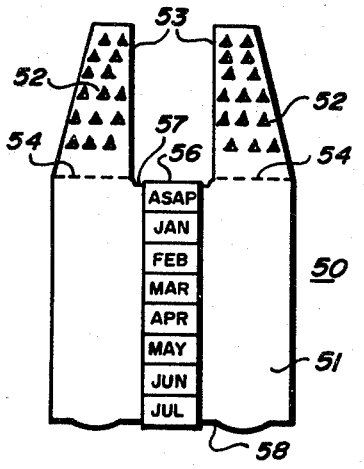
FIG. 5 is a front view, prior to the ear means being bent, showing another embodiment of the invention.

Referring to FIG. 5, there is shown a variable index tab 50 which includes an integral base member 51 having a pair of ear means 52—52. The ear means 52—52 are provided with a plurality of teeth 53—53. In a preferred form, the variable index tab 50 is formed of metal such as tin, steel, iron, and the like. The teeth 53 are engageable with the paper or cardboard of a file folder (not shown) when the ear means 52—52 are bent along the bend line 54—54. Hence, in the embodiment depicted in FIG. 5, a metal tab structure for affixing to a file folder, as contrasted with a plastic or cardboard structure shown in FIGS. 1-3, is suggested.

The embodiment depicted in FIG. 5 further includes a flexible index strip 56 which can rotate within notches 57-58 at opposite edges of the portion 51. The rotatable strip 56 is preferably formed of polyethylene terephthalate.

As shown in FIG. 5, the flexible strip 56 depicts abbreviations of names of the months, includes an indication of ASAP for indicating current data (as soon as possible). The index strip 56, in lieu of depicting months of the year, may include other alphanumerical indicia, such as that depicted in FIGS. 1 and 2.

DESCRIPTION OF AN ALTERNATE EMBODIMENT

Figure 6:
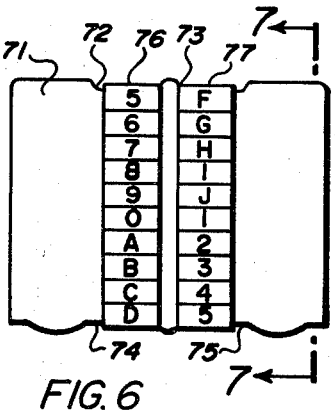
FIG. 6 is a front view of still another embodiment of the invention.
Figure 7:
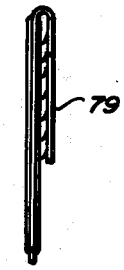
FIG. 7 is a side view of the embodiment shown in FIG. 6 taken along the line 7—7 thereof.

As shown in FIG. 6, an index tab includes a base portion 71 having a plurality of spaced notches 72, 73 along one edge of the portion 71 and a like plurality of opposed notches 74-75 along the opposite edge of the portion 71. A like plurality of indexible strips 76, 77 of flexible material (such as polyethylene terephthalate) are adapted to rotate within the respective notches of the base portion 71. Hence, the rotatable strip 76 rotates within the notches 72, 74 of the base member 71; the rotatable strip 77 rotates within the notches 73, 75 of the base member 71. Hence, by simple manual operation of the rotatable strips, the user can depict any two desired indicia. For example, as shown in FIG. 6, the numeral 5 is depicted at the top for the strip 76, whereas the alphabetic character F is depicted at the top for the rotatable strip 77. The variable index tab FIG. 6 is shown with its ears 79 already in its bent position for engagement with a file folder (not shown). As shown in FIG. 7, the base portion 71 is formed of metal and can be adapted to be engageable with a file folder by suitable metal teeth, not shown. The embodiment depicted in FIGS. 6 and 7 shows a metal unit including a plurality (in this example, 2) of rotatable strips. It is to be understood, however, more than two strips can be used, for example, three, four, five, etc., with appropriate additional notches in the base portion. It is further to be understood that in lieu of a metal unit, the index tab can be formed of paper or cardboard similar to the version depicted in FIGS. 1–3.

DESCRIPTION OF AN ADDITIONAL EMBODIMENT OF THE INVENTION

Figure 8:
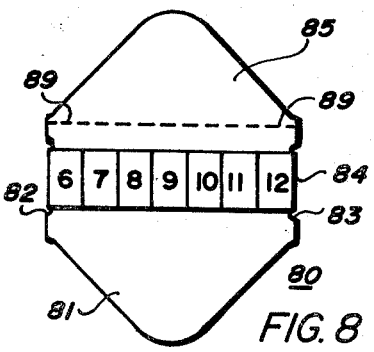
FIG. 8 is a front view of still another embodiment of the invention.

As depicted in FIG. 8, a foldable variable index tab 80 includes an integral base member 81 having notches 82 and 83 at the left and right edges thereof, respectively, so as to receive a rotatable strip 84 of flexible material, such as polyethylene terephthalate, which circumscribes the base portion 81 and which is engageable within the opposed strip engageable notches 82,83. Thus, the rotatable strip 84 is oriented such that a point on the rotatable strip 84, upon rotation, rotates within a horizontal plane.

Figure 9:
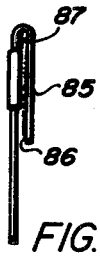
FIG. 9 is a side view of the embodiment shown in FIG. 8.

The portion 81 includes an upper bendable portion, or ear, 85 having an adhesive backing 86, as depicted in FIG. 9. The adhesive backing 86 affixed to the ear 85, and a portion of an adhesive backing 87 which is coupled to the top of the portion 81 at its rear surface, is engageable with the file folder 88 as shown in FIG. 10.

Figure 10:
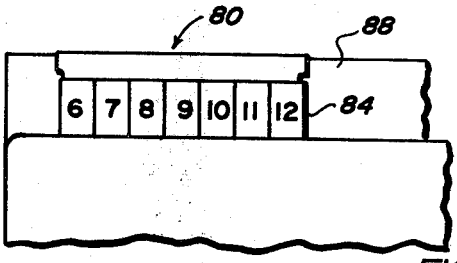
FIG. 10 is a view of the embodiment shown in FIGS. 8 and 9 shown attached to a file folder.

Thus, as shown in FIG. 10, the variable index tab 80 can be affixed to a file folder 88 with a rotatable strip 84 of indicia rotatable about a horizontal axis with regard to the bend line 89—89 of the ear 85.

DESCRIPTION OF OTHER EMBODIMENTS OF THE INVENTION

Figure 12:
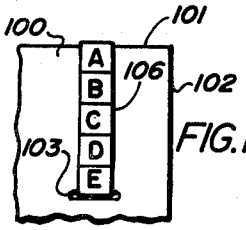
FIGS. 11, 12, and 13 are partial views of yet another embodiment of the invention, wherein a face portion of the file folder is deleted.
Figure 13:
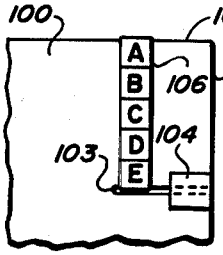
Figure 11:
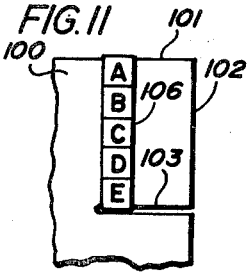

Referring to FIGS. 11, 12, and 13, a variable index tab for a file folder can include the file folder 100, per se, with a rotatable strip 106 of flexible material. The file folder 100 has a top reference edge 101 and a side edge 102. The file folder has a slit 103 which is formed in the folder parallel to the reference edge 101. As depicted in FIGS. 11—13 various embodiments are shown with the same reference numeral being applied to the slit 103. In the version shown in FIG. 11, the slit 103 extends through to the side edge 102; in the version shown in FIG. 12, the slit does not extend to the side edge 102; and in the version shown in FIG. 13, the slit 103 extends to the side edge 102 but is covered with tape means 104 to provide for rigidity to the file folder. When the face portion 105 of the folder is folded back onto the main portion of the file folder 100, a portion of the rotatable strip 106 and a rear portion of a file folder 100 is exposed. The rotatable strip of flexible material, such as polyethylene terephthalate, circumscribes a portion of the file folder 100 and is bounded by the reference edge 101 and the slit 103.

Figure 14:
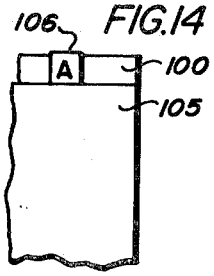
FIG. 14 is a view of the file folder of the embodiment shown in FIGS. 11-13 with the face portion of the file folder shown in place.
Figure 15:
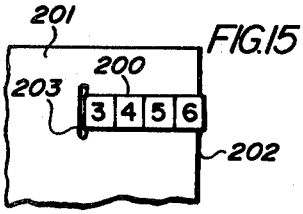
Figure 16:
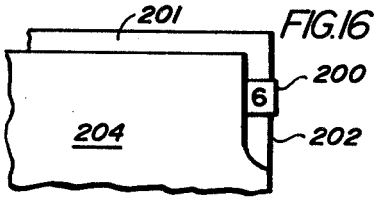

In a similar fashion, the version shown in FIGS. 14–16 depicts a strip 200 which circumscribes a portion of the file folder 201 and is bounded by a side edge 202 of the file folder 201. A slit 203 runs parallel to the side edge 202. Thus, when the face 204 of a file folder, which has a portion of its side removed, closes upon the file folder 201, a portion of indicia of the rotatable strip 201 is exposed as shown in FIG. 16.

CONCLUSION

As can be seen from the description hereinabove, the index tab when formed of paper/cardboard is foldable, and the inner rotatable strip formed of polethylene terephthalate has long-wearing characteristics. The tab can be cut in a mass production manner and is bendable. The rear of the tab has a self-sticking adhesive so it can adhere to a file folder. The rotatable thin strip of polyethylene terephthalate can have a plurality of designations, for example, 0 through 12, wherein 0 indicates that the file is ready for use, 1 indicates one month action, 2 indicates two months action, and so on. The twelve designations can be color coded. Alternatively, or optionally, the 0 can mean "no followup required"; the numbers can be replaced with designations "JAN" through "DEC". In certain embodiments, two bands can be used to indicate "days". Or three bands can be used to indicate day of month, such as 23 or 15, and to indicate year.

In essence, an important feature of the invention resides in the fact that the rotatable strip is a band, and that it is rotatable, even though the tab be permanently affixed to the file folder. As will be appreciated, the variable index tab is inexpensive, in that it consists essentially of two components, namely the integral base member and the rotating band. It does not require an operator to insert different slides into a preformed slot in a file folder. Conveniently, to change, the strip is manually rotated to a different color or number, or two strips are rotated, etc.

Single or multiple combinations of numbers, colors, or letters, printed on flexible bands of variable lengths and widths, can be rotated about a more rigid piece of material for the purpose of signalling a color code, date, quantity, price, or for the purpose of referencing an alphabetic or numeric retrieval system.

The rigid piece material can be made in such a fashion that it can be clipped or glued to the item requiring reference.

Various modifications can be performed without departing from the spirit and scope of this invention as will be appreciated from the discussion hereinabove. It will be noted, however, that for the purpose of the following claims, the term "file folder" is meant to be broadly construed, and includes such items as a file folder, a ledger sheet, a card, or any flexible sheet which is adapted to be filed in cabinets, drawers and the like, or in books.

What is claimed is:

1. A variable index tab for a file folder comprising a relatively flat base member including a bendable portion adapted to be affixed about an edge of said file folder, said base member being formed with a notch at two opposite sides thereof; and a rotatable strip of flexible material circumscribing said member and engaged within said notches, said strip carrying a series of identifying indicia.

2. The tab as recited in claim 1 further comprising an adhesive backing formed on a portion of said base member.

3. The tab as recited in claim 1 wherein said bendable portion is bendable about a line, and a point on said strip is adapted to rotate about a path, said path forming a plane parallel to said line.

4. The tab as recited in claim 1 wherein said bendable portion is bendable about a line, and a point on said strip is adapted to rotate about a path, said path forming a plane perpendicular to said line.

5. The tab as recited in claim 1 wherein said member is metallic, and said member portion is formed with teeth for mechanically engaging with said folder.

6. The variable index tab as recited in claim 1 wherein said base member is provided with a like plurality of spaced notches at said two opposite sides of said member, and wherein said index tab, in addition to said member, comprises a like plurality of rotatable strips of flexible material circumscribing said member and respectively engaged within an opposing pair of said notches, each of said strips carrying a series of identifying indicia.

7. The tab as recited in claim 6 wherein said like plurality is 2.

8. A variable index tab for a file folder having opposed surfaces, comprising an integral base member including a relatively flat base portion adapted to be engaged with one of said surfaces of said file folder, said portion having a pair of opposed strip engageable notches at opposite edges of said member, and at least one car means bendable about said base portion and adapted to be engaged with the other of said surfaces; and a rotatable strip of flexible material circumscribing said base portion and engaged within said opposed strip engageable notches, said strip carrying a series of identifying indicia.

9. The tab as recited in claim 8, wherein said ear means are bent about a fixed axis and wherein a point on said strip is rotated within a plane perpendicular to said fixed axis.

10. The tab as recited in claim 8, wherein said ear means are bent about a fixed axis and wherein a point on said strip is rotatable within a plane parallel to said fixed axis.

11. In combination, a file folder having a reference edge and side edge intersecting with said reference edge, said file folder containing a slit parallel to one of said edges; and a rotatable strip of flexible material circumscribing a portion of said file folder and being bound by said one edge and said slit.

12. The combination as recited in claim 11 wherein said one edge is said reference edge.

13. The combination as recited in claim 11 wherein said one edge is said side edge.

14. The combination as recited in claim 12 wherein said slit extends to said side edge.

15. The combination as recited in claim 14 wherein a portion of said slit not bounded by said strip is closed by tape means extending to said side edge.

16. The combination as recited in claim 12 wherein said slit does not extend to said side edge.

* * * * *